United States Patent [19]

Makibbin

[11] 4,366,865

[45] Jan. 4, 1983

[54] PACKAGED SPRINKLER SYSTEM USING A DEAD WATER TANK

[76] Inventor: James J. Makibbin, 1339 Lincoln Woods Dr., Baltimore, Md. 21228

[21] Appl. No.: 222,061

[22] Filed: Apr. 7, 1981

[51] Int. Cl.[3] ..... A62C 35/00

[52] U.S. Cl. ..... 169/13; 169/16

[58] Field of Search ..... 169/5, 13, 16, 17, 19, 169/20, 54, 56, 60, 57, 26

[56] References Cited

U.S. PATENT DOCUMENTS

| | | | |
|---|---|---|---|
| 1,421,433 | 7/1922 | Epps | 169/13 |
| 3,179,181 | 4/1965 | Banzato | 169/13 |
| 4,330,040 | 5/1982 | Ence et al. | 169/13 |

*Primary Examiner*—F. J. Bartuska
*Attorney, Agent, or Firm*—Walter G. Finch

[57] ABSTRACT

The invention is an improved sprinkler system for homes and other small requirement applications. The special apparatus and special connection arrangement is packaged into a self-contained unit for combining with a dead water tank. The system provides for a water supply to sprinkler heads from a domestic type service as a by-pass, but with an automatic full-flow supply, upon increased demand, from a dead water tank. The dead water tank has a resupply system built into it. A special test system is provided to check the system operation without opening a sprinkler head. The system is adaptable by a simple change to a dry-pipe system where freezing must be prevented.

6 Claims, 3 Drawing Figures

PACKAGED SPRINKLER SYSTEM USING A DEAD WATER TANK

BACKGROUND AND SUMMARY OF THE INVENTION

The invention relates to sprinkler systems and in particular to sprinkler systems for homes and other small requirement applications. Specifically, the invention relates to a sprinkler system having a compact packaged unit (of the special control apparatus and the special connection arrangement of piping of the special control apparatus) and a dead water tank tied into the compact packaged unit for operation upon an increased demand for water.

Sprinkler systems of the prior art have been provided for large buildings and large demands for sprinkler coverage. However, these large systems are not directly applicable to small requirements, such as homes and similar small needs. One reason being the huge size of the control equipment and the fact that the designs are not readily reproducible in small size for the small requirement applications. The present invention overcomes this deficiency by providing a compact packaged unit of special apparatus and a special connection arrangement.

The present invention can also be adapted by a simple modification to a dry-pipe system when there is a need to prevent freezing in the system.

The present invention is readily adaptable to new construction where the piping for the system is incorporated into the interior of the walls the same as other plumbing work during the construction work.

The present invention is also readily adaptable for installation in old homes or other small structures. In such cases the relatively small piping can be encased or suitably covered by known methods, or it may be piped overhead through attics. In the latter case, part or all of the piping may have to be a dry-pipe arrangement as aforementioned to prevent freezing.

The aforementioned "packaged" unit is of relative small size, being less than 24 inches square and but a few inches in depth to clear the small apparatus.

It is to be noted that this invention concerns the aforementioned compact packaged unit and the dead water tank and the arranged connection between them. The system makes use of the various sprinkler heads known in the art.

The National Fire Protection Association (NFPA) has established requirements for fire protection in various types of buildings. The NFPA 13-D criteria for homes and similar small buildings is such that a normal water supply to a home through a ⅝" meter would not meet the water supply requirements, particularly if more than one sprinkler head opened during a fire emergency. To meet the need, this invention provides a sprinkler system that is capable of supplying the required water.

The present invention provides for a by-pass system direct from the domestic supply to supply the system. However, upon increased demand, the apparatus of the present system takes over and provides water from the dead water tank. As water from the dead water tank is used, a float valve means provides for automatic refill from the domestic system.

The system of this invention is tied into the electrical system of the home or building just after the meter by a panel connection separate from the other electrical panel means supplying the structure.

The system of the invention is also arranged so that if an electrical failure occurs the system will automatically provide water from the domestic system, at a lesser rate, but nevertheless, a measure of protection even during an electrical failure.

It is also to be noted that where there isn't a domestic water system to provide a water supply, such as on a farm or in other areas outside the domestic system limits, the present invention can be connected to whatever water supply means is available, such as a pump from a well or from a pressure tank system.

The dead water tank of the present invention is sized so as to be compatible with entrances into the home or other structure so that the installation can be made in any existing building. If necessary, the dead water tank can be made in a series of smaller tanks, connected in series, to meet the designed capacity requirement, but providing the smaller tanks to negotiate any restricted entrances into the structure.

A special test circuit is part of the invention so that the pump in system and the alarm bell can be tested periodically without the need of an open sprinkler head.

It is, therefore, an object of the invention to provide a packaged sprinkler system for homes and other small structures.

It is also an object of the invention to provide a packaged sprinkler system that initially can provide a water supply direct from a domestic water system.

It is another object of the invention to provide a packaged sprinkler system that automatically provides a backup supply of water from a dead water tank upon increased demand for water.

It is also another object of the invention to provide a packaged sprinkler system that has a compact self-contained unit of apparatus and arranged connections of the apparatus.

It is yet another object of the invention to provide a packaged sprinkler system that can be connected to other water supply means when a domestic system is not available.

It is still another object of the invention to provide a packaged sprinkler system that has a test means to check the system for operability.

It is yet still another object of the invention to provide a packaged sprinkler system that may be operated with a dry-pipe arrangement to prevent freezing.

Further objects and advantages of the invention will become more apparent in the light of the following description of the preferred embodiments.

DESCRIPTION OF THE PREFERRED EMBODIMENTS

Figure 1:
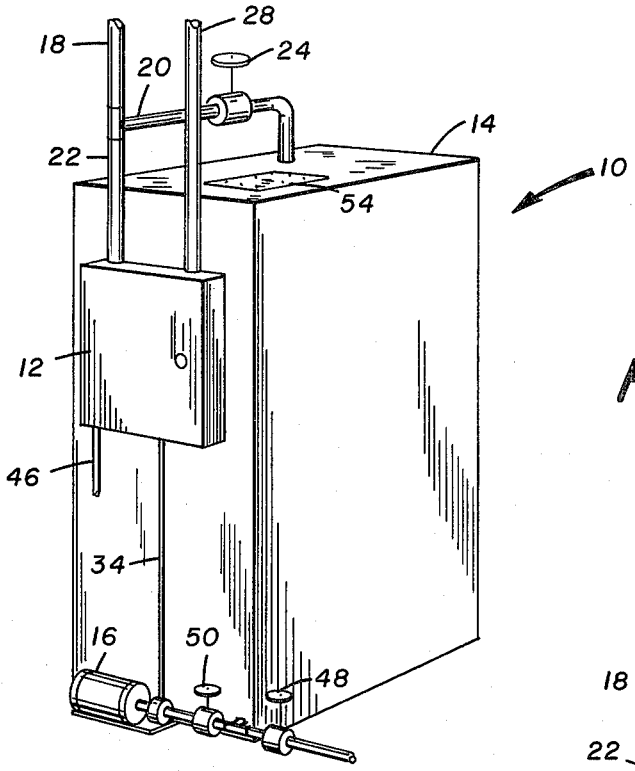
FIG. 1 is a pictorial view of a packaged sprinkler system using a dead water tank.
Figure 2:
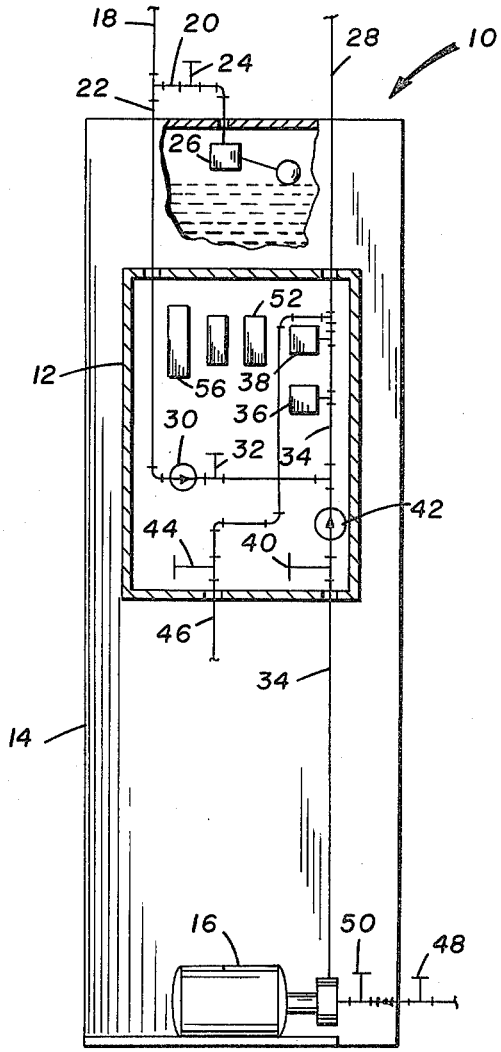
FIG. 2 is an end view of a packaged sprinkler with portions removed for clarity.

Referring to the drawings and particularly to FIGS. 1 and 2, a packaged sprinkler system using a dead water tank is shown at 10.

The packaged sprinkler system 10 consists of a compact self-contained unit 12 of apparatus and arranged connections, a dead water tank 14, a water pump 16, and certain other associated elements as hereinafter described.

As may be seen in FIG. 1, the dead water tank 14 has the compact self-contained unit 12 of control means secured to one vertical surface of the dead water tank 14. The dead water tank 14 may be varied in size to meet the requirements for the structure to be protected in accordance with the National Fire Protection Association criteria 13-D. Normal size of the dead water tank 14 for an ordinary home may be approximately 350 gallons, but it is to be understood that the size will be in accordance with criteria noted hereinbefore.

It is also to be noted that only one representative dead water tank 14 is show, however, where installation requirements in conjunction with a structure require smaller tank units to facilitate the installation, the dead water tank 14 may be a plurality of smaller tanks to make up the total capacity and connected in series with each other at the installation point.

The water pump 16 is shown schematically in FIG. 1 on the same dead water tank 14 surface as the compact self-contained unit 12, and in greater detail for the connection in FIG. 2. The compact self-contained unit 12 is shown in FIG. 1 with a closed cover, as is the normal situation. The cover is locked to prevent tampering with indicator control valves as hereinafter described. In FIG. 2 the cover has been removed from the compact self-contained unit 12 in order to show the apparatus and arranged connections in detail, all of which is described hereinafter.

The dead water tank 14 is coated on the interior with protective material as known in the art. The compact self-contained unit 12 is suitably affixed to the surface of the dead water tank 14 by known means.

Turning now to FIG. 2 to describe the apparatus, the connecting arrangement of the elements of the apparatus to provide the operations necessary for packaged sprinkler system 10 using the dead water tank 14, the supply of water is received from the domestic water supply 18. As noted hereinbefore, other water supply means may be used where a domestic water supply 18 is not available and the supply connection would be at this same point. Hereinafter the reference will be made as the water supply 18.

The water supply 18 branches into two directions. A branch 20 supplies the dead water tank 14, and a branch 22 provides a special by-pass to the sprinkler heads as hereinafter described.

The branch 20 passes through a control valve 24, then into the dead water tank 14 where the flow is controlled by a float valve 26. Control valve 24 is left open at all times so that there is a constant water supply to dead water tank 14, except that the control valve 24 is used to close off the supply when the dead water tank 14 requires servicing necessitating that the water flow be stopped. Visual means to indicate that the control valve 24 is open may be used and is suggested.

As the dead water tank 14 fills with water the float valve 26 cuts off the flow of water as the water level in the dead water tank 14 reaches the float valve 26 ball and closes the inlet. As the operation of the dead water tank 14 takes place, as hereinafter described, the water level in dead water tank 14 is reduced as water pump 16 pumps water to the sprinkler heads that are open. As the water level drops the float valve 26 opens automatically and the water supply 18 feeds more water to the dead water tank 14 through the branch 20, thus replenishing the water as it is used.

Turning now to the apparatus and connection arrangements of the invention in the compact self-contained unit 12, as shown in FIG. 2, the operation is described hereinafter.

As one or more sprinkler heads open on the sprinkler means 28, due to action of a fire that activates the sprinkler heads, the packaged sprinkler system 10 begins to operate. It is to be noted that only the piping means leading to the sprinkler means 28 is shown, the use of sprinkler heads beyond this point is as known in the art.

As one sprinkler head of the sprinkler means 28 is activated, the immediate response is a supply of water to and through the open sprinkler head by way of the branch 22 which by-passes the pump system, described hereinafter, and gives the immediate response to the open sprinkler head.

The water passing through branch 22 passes through a check valve 30, an indicating control valve 32, then through the main sprinkler supply line 34 to the sprinkler means pipe 28.

As the water passes through the main supply line 34 it passes pressure switch 36 and flow switch 38. If the demand for water at the sprinkler heads is greater than the supply capabilities from branch 22, for example if a plurality of sprinkler heads have opened, the pressure drops and pressure switch 36 is activated. The activated pressure switch 36 activates the water pump 16 which begins to draw water from the dead water tank 14 and pump it through the main supply line 34.

At the same time, as the water passes the flow switch 38, it automatically activates the alarm (usually a bell) to indicate that the packaged sprinkler system 10 is in operation. The alarm will continue as long as water is flowing past the flow switch.

The water from dead water tank 14 being pumped into the main supply line 34 by water pump 16 is at a rate to meet the criteria 13-D of the National Fire Protection Association. As the water passes through the main supply line 34 it passes through an indicating control valve 40 and a check valve 42.

It is to be noted that there is a difference in volume and pressure between the water supplied through branch 22 and the water supplied by water pump 16 through its connection to the main supply line 34. When the supply is through branch 22 it passes through check valve 30 and effectively closes check valve 42 (as the water pump 16 is not operating) and thus directs the water to the sprinkler means pipe 28. When the water pump 16 is activated it passes through check valve 42 and effectively closes check valve 30, due to the greater volume and pressure, thus stopping the flow of water from branch 22 to the sprinkler means pipe 28. As noted hereinbefore, as water pump 16 now begins drawing water from the dead water tank 14, the water level drops and float valve 26 opens and a resupply of water is fed into the dead water tank 14 through branch 20.

Valves 32 and 40 have been noted as "indicating" control valves. These valves are such that the matter of whether they are "open" or "closed" can be identified directly. They are "open" when the packaged sprinkler system 10 is set for operation and are only closed when maintenance work is being done on the system.

When the sprinkler system has operated and the fire is put out, it is necessary to reset the packaged sprinkler syystem 10. After the water pump 16 has been shut down, indicating control valves 32 and 40 are closed, drain valve 44 is opened to drain the sprinkler means pipe 28 through drain 46, the open sprinkler heads that activated are replaced, drain valve 44 is closed, indicating control valves 32 and 40 are opened, and in the meantime float valve 26 has opened and filled dead water tank 14 to the proper level. Drain valve 44 drains system water around flow switch 38 so as to protect the flow switch 38.

It is to be noted that to facilitate maintenance, a drain valve 48 at the bottom of the dead water tank 14 permits draining the tank if necessary, and a control valve 50, together with indicating control valve 40 permits isolating the water pump 16 for maintenance without draining the tank.

Caution must be exercised to assure that control valve 50 is always open when the packaged sprinkler system 10 is in operation, as mentioned for control valve 24. These valves should be locked in open position.

Figure 3:
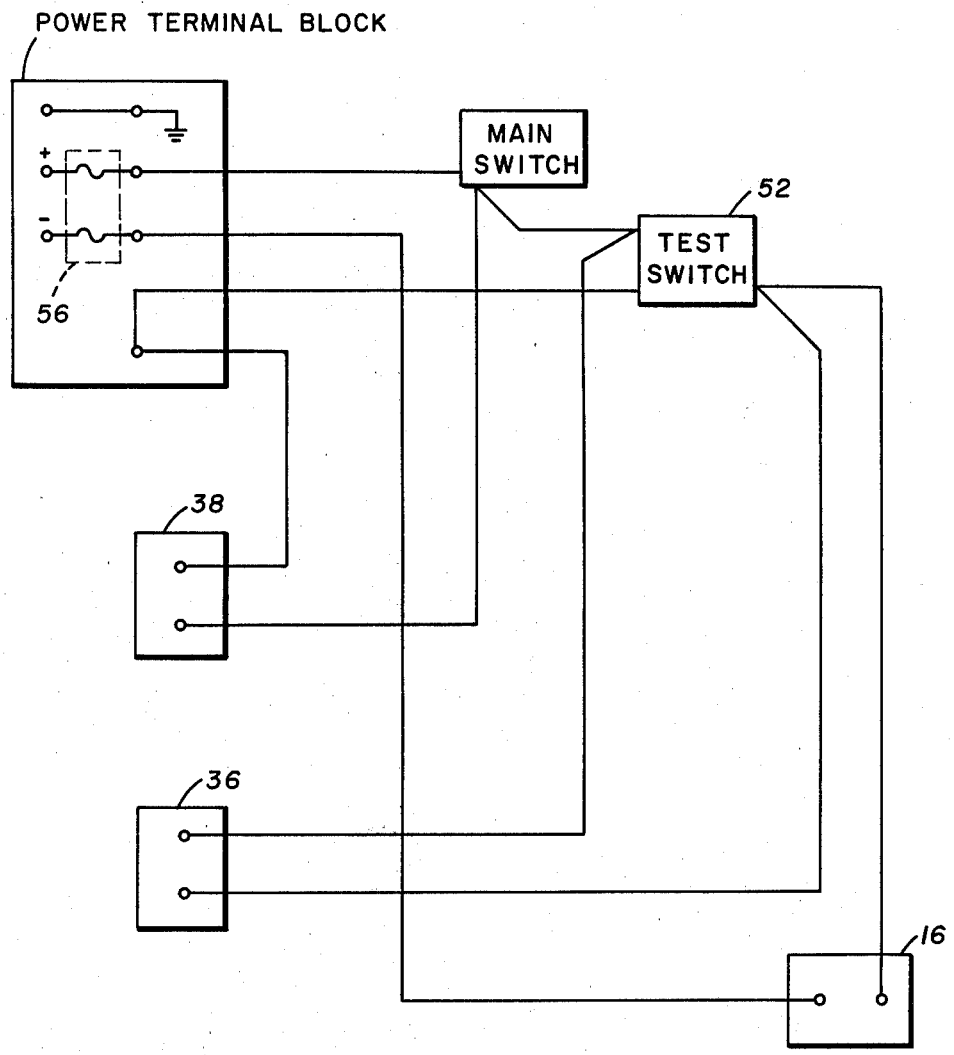
FIG. 3 is a schematic wiring diagram of the electrial control circuit of a packaged sprinkler system.

A test switch 52 in the compact self-contained unit 12 permits periodically testing the water pump 16 and the alarm feature of the flow switch 38 without activating a sprinkler head. The wiring connection of test switch 52 is shown in FIG. 3 for its connection to the flow switch 38 and the water pump 16. The wiring shown in FIG. 3 may be individual wires or formed into cables. A system circuit breaker 56 protects the system.

If the sprinkler means pipe 28 is to be a dry-pipe arrangement to prevent freezing, the flow switch 38 is replaced by a dry-valve element, not shown, which has an alarm system connected to it. Said dry-valve element is connected to a compressed air means.

Access means 54 to the interior of dead water tank 14 is provided for servicing the float valve 26 and the interior of the dead water tank 14 as necessary.

As can be readily understood from the foregoing description of the invention, the present structure can be configured in different modes to provide the ability of a packaged sprinkler system using a dead water tank. Accordingly, modifications and variations to which the invention is susceptible may be practiced without departing from the scope and intent of the appended claims.

What is claimed is:

1. In a sprinkler system having a plurality of sprinkler heads, a packaged sprinkler system using a dead water tank, comprising:

a plurality of sprinkler heads;

a tank means;

a packaged control means, said packaged control means being compact and self-contained, said packaged control means being affixed to said tank means;

a pump means, said pump means being affixed to said tank means and connected to the interior thereof and communicating therewith, said pump means being further connected to said packaged control means, and a water supply means, said packaged sprinkler system being connected to said water supply means, said water supply means having a first distribution means and a second distribution means in said packaged sprinkler system, said first distribution means being connected to said tank means and communicating therewith, and said second distribution means being connected to said packaged control means, and a water level control means, said water level control means being located in the interior of said tank means and connected to said first distribution means and communicating therewith, said packaged control means consisting of:

an enclosed housing means said enclosed housing means having an access covering on one side thereof;

a first piping means said first piping means being located in said housing means and being connected to said second distribution means and communicating therewith;

a second piping means, said second piping means being located in said housing means and being connected to said first piping means and communicating therewith, said second piping means extending to the exterior of said housing means and being further connected to said plurality of sprinkler heads and communicating therewith;

a third piping means, said third piping means being located in said housing means and being connected to said second piping means and communicating therewith, said third piping means extending to the exterior of said housing means and being further connected to said pump means and communicating therewith;

a first check valve;

a first control valve, said first check valve and first control valve being located in said housing means and installed in line between said first piping means and said second piping means, said first check valve and first control valve communicating with and between said first and second piping means;

a second check valve;

a second control valve; said second check valve and second control valve being located in said housing means and installed in line between said third piping means and an intermediate point of said second piping means, said second check valve and second control valve communicating with and between said third and second piping means;

a drain valve, said drain valve being located in said housing means, said drain valve being connected to said second piping means and communicating therewith, said drain valve being connected to said second piping means at a location immediately before said second piping means extends to the exterior of said housing means, said drain valve further communicating with the exterior of said housing means.

2. The packaged sprinkler system as recited in claim 1, and additionally, a pressure switch, said pressure switch being located in said housing means and being installed in said third piping means, said pressure switch being electrically connected to said pump means to activate said pump means upon signal.

3. The packaged sprinkler system as recited in claim 2, and additionally, a flow switch and an alarm means, said flow switch being located in said housing means and being installed in said third piping means, said flow switch being electrically connected to said alarm means, said alarm means being located outside said housing means.

4. The packaged sprinkler system as recited in claim 2, and additionally, a dry-valve means, a compressed air means, and air alarm means, said dry-valve means being located in said housing means and being installed in said third piping means, said dry-valve means being electrically connected to said alarm means, said alarm means being located outside said housing means, said dry-valve means being connected to said compressed air means.

5. The packaged sprinkler system as recited in claim 3, and additionally, a test means for said pump means and said alarm means, said test means being located in said housing means and being capable of operating said pump means and said alarm means without operating said sprinkler system.

6. The packaged sprinkler system as recited in claim 4, and additionally, a test means for said pump means and said alarm means, said test means being located in said housing means and being capable of operating said pump means and said alarm means without operating said sprinkler system.

* * * * *